US005953820A

United States Patent [19]

Vasudeva

[11] Patent Number: 5,953,820

[45] Date of Patent: Sep. 21, 1999

[54] CHISELS AND SCRAPERS WITH REPLACEABLE BLADES

[75] Inventor: Kailash C. Vasudeva, Waterloo, Canada

[73] Assignee: Maxtech, Inc., Roseville, Mich.

[21] Appl. No.: 08/907,499

[22] Filed: Aug. 8, 1997

Related U.S. Application Data

[60] Provisional application No. 60/031,253, Nov. 12, 1996.

[51] Int. Cl.[6] ..... B25D 3/00

[52] U.S. Cl. ..... 30/125; 30/167; 206/349; 206/375

[58] Field of Search ..... 30/125, 167, 167.1, 30/169; 206/349, 352, 375, 379, 564

[56] References Cited

U.S. PATENT DOCUMENTS

| | | | |
|---|---|---|---|
| 17,128 | 4/1857 | Kilmer et al. | 30/167 |
| 108,596 | 10/1870 | Hundley | 30/125 |
| 143,413 | 10/1873 | Jelliffe | 30/167 |
| 178,627 | 6/1876 | Gordon et al. | 30/167 |
| 420,529 | 2/1890 | Bostian | 30/167 |
| 433,078 | 7/1890 | Graham | 30/167 |
| 1,082,802 | 12/1913 | Full | 30/167 |
| 2,131,358 | 9/1938 | Rothschild | 30/125 |
| 3,370,697 | 2/1968 | Levey et al. | 206/375 |
| 3,829,967 | 8/1974 | Gilbert | 30/125 |
| 5,441,152 | 8/1995 | Estes | 206/349 |
| 5,537,747 | 7/1996 | Cacciotti et al. | 30/125 |

*Primary Examiner*—Hwei-Siu Payer
*Attorney, Agent, or Firm*—R. Craig Armstrong

[57] ABSTRACT

The hand tool has a shaft with a distal end which is configured to receive any one of a variety of different sized chisel or scraper blades or the like, via corresponding male and female dovetail connections, for example. Storage space for the extra blades, if desired, may be provided in the handle which is secured to the shaft, or may be provided via depressions in a panel of a tool case of the type commonly referred to as "gift cases". Where storage space is provided in the handle, preferably this is accomplished by virtue of a spring-loaded collar which overlies lower portions of elongated rotatable cover pieces, preventing rotation. When the spring-loaded collar is retracted, the cover pieces can be rotated, to reveal storage areas on either side of the handle.

12 Claims, 9 Drawing Sheets

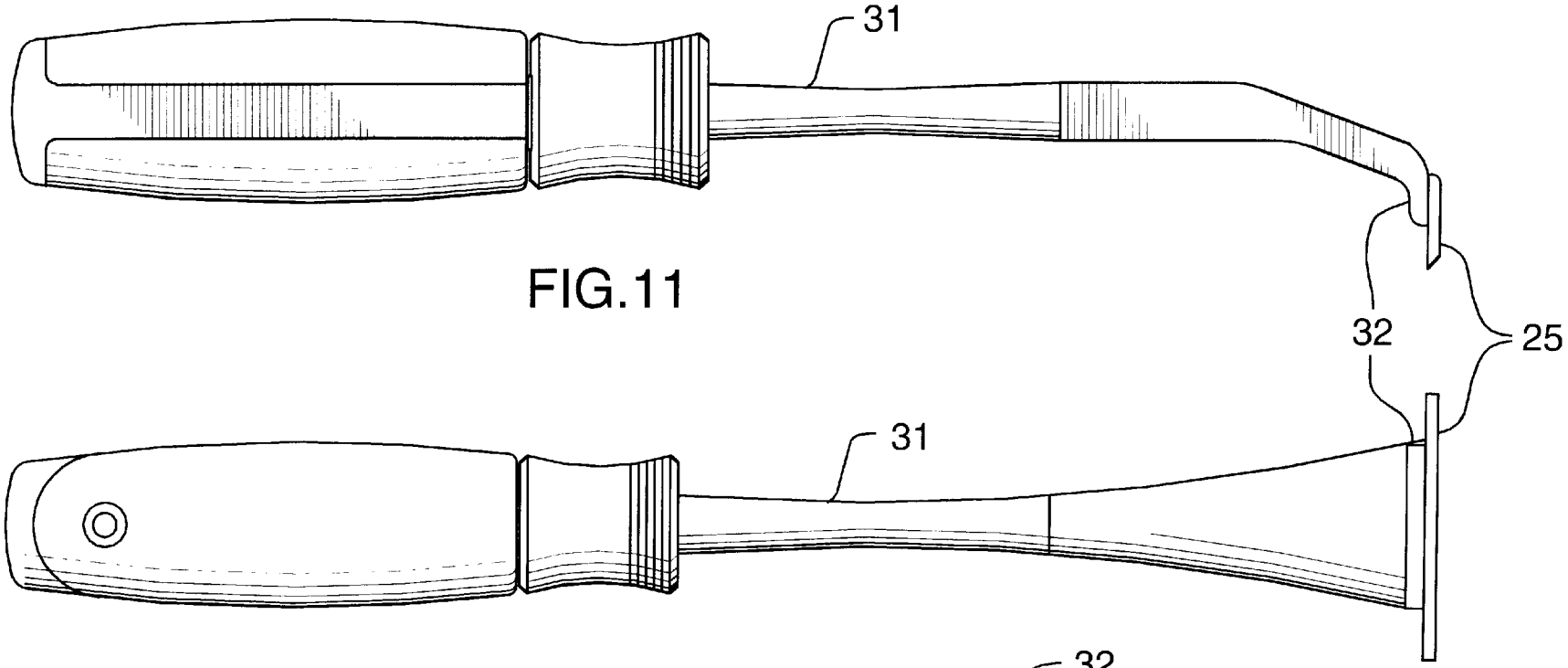
FIG.11
FIG.12
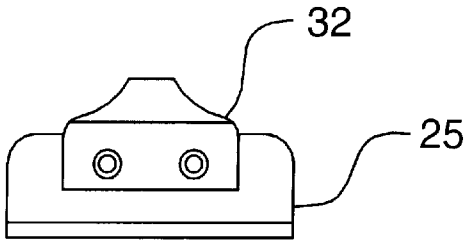
FIG.13

CHISELS AND SCRAPERS WITH REPLACEABLE BLADES

This application claims benefit of provisional application 60,031,253 filed Nov. 12, 1996.

BACKGROUND OF THE INVENTION

This invention relates to hand tools, and in particular to chisels and scrapers.

With chisels and scrapers, different sizes blades or tips are commonly required, and this is typically achieved by having a variety of individual tools, one for each different size desired.

SUMMARY OF THE INVENTION

In the invention, the desirability of having one tool which can provide a variety of sizes has been recognized. Thus the tool is provided with a shaft having a distal end which is adapted to receive any one of a variety of different sized chisel or scraper blades. Storage space for the extra blades, if desired, may be provided in the handle which is secured to the shaft, or may be provided via depressions in a panel of a tool case of the type commonly referred to as "gift cases".

Where storage space is provided in the handle, preferably this is accomplished by virtue of a spring-loaded collar which overlies lower portions of elongated rotatable cover pieces, preventing rotation. When the spring-loaded collar is retracted, the cover pieces can be rotated, to reveal storage areas on either side of the handle.

BRIEF DESCRIPTION OF THE DRAWINGS

The invention will be explained in greater detail below, with reference to the accompanying drawings of examples, in which:

FIG. 11 is a side view of a second version of a scraper;

FIG. 12 is a plan view of the second scraper;

FIG. 13 is an end view of the second scraper;

DETAILED DESCRIPTION OF THE PREFERRED EMBODIMENTS

Figure 1:
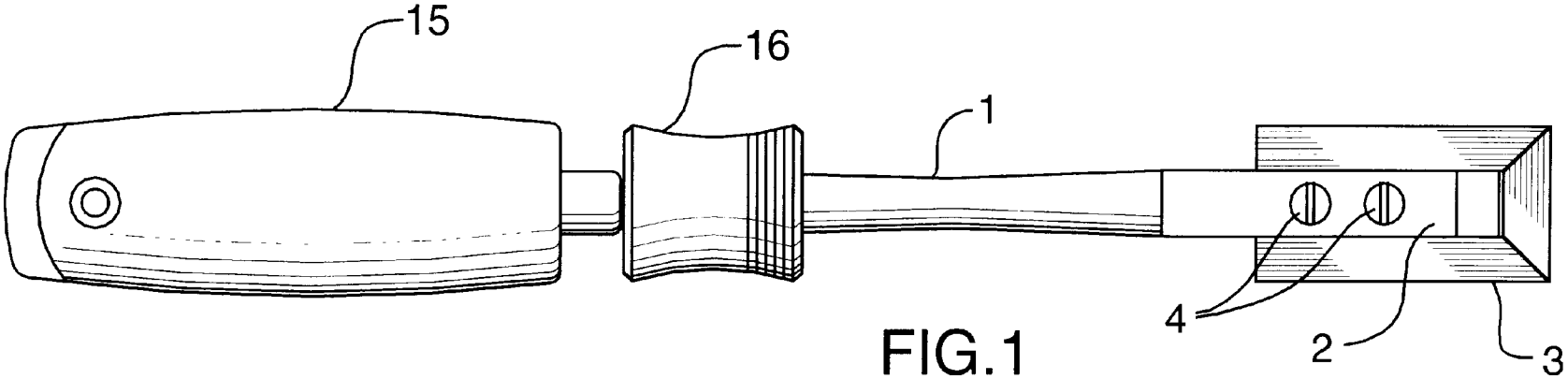
FIG. 1 is a plan view of a chisel according to the invention.
Figure 4:
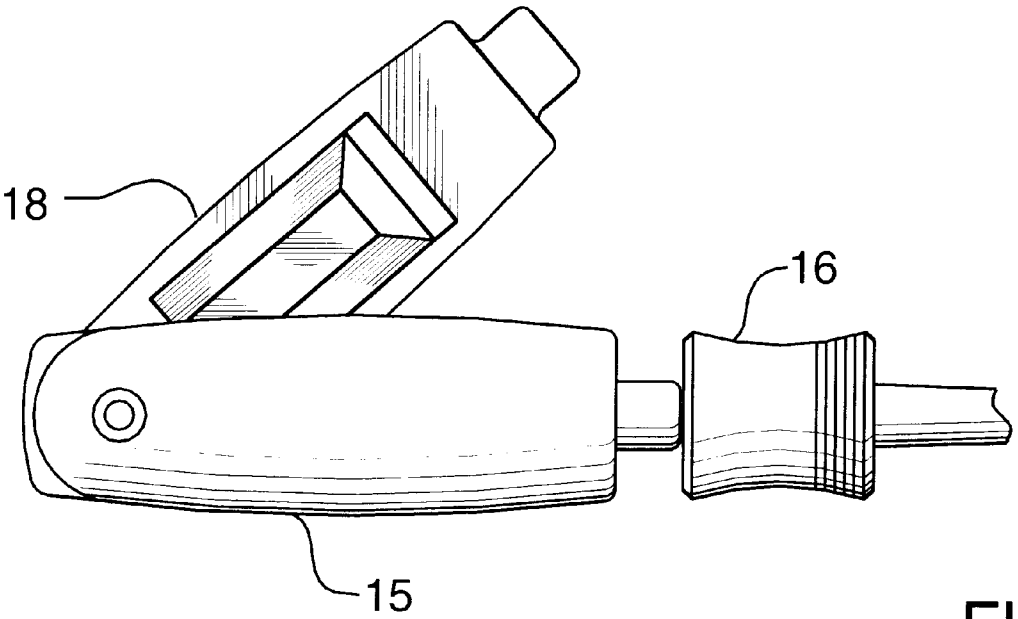
FIG. 4 is a side view showing a storage compartment in the handle swung away from the handle.
Figure 2:
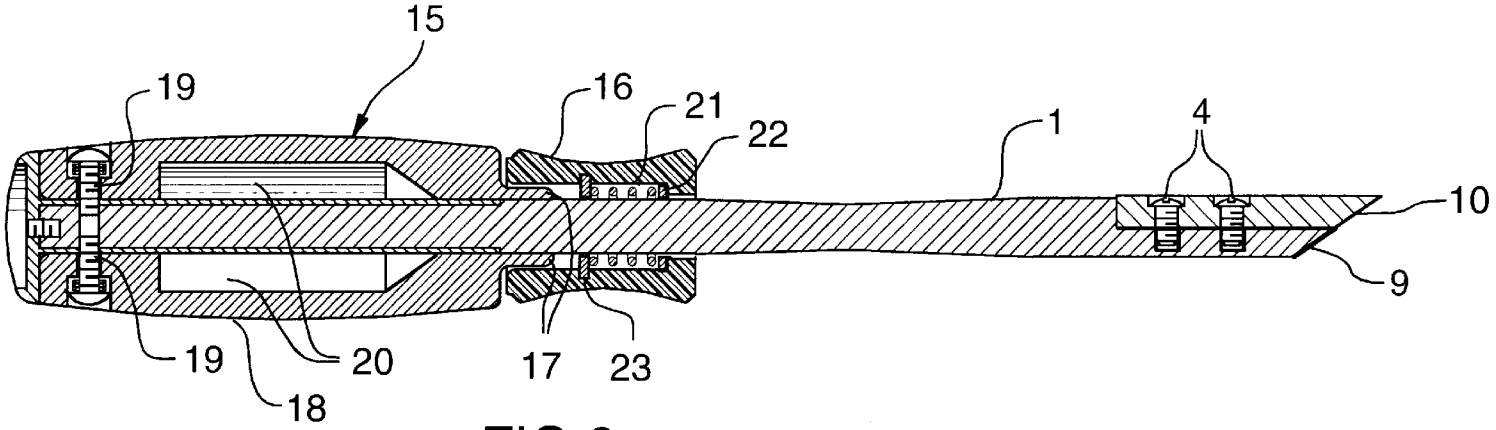
FIG. 2 is a cross-section of the chisel.

Referring to the drawings, the chisel, for example, has a shaft 1 having a distal end 2 which is adapted to receive replacement blades or any one of a variety of different-width chisel blades 3. The blades are secured by any suitable means, such as machine screws 4, the holes for the screws being suitably threaded, or as in FIGS. 5–8, via a thumbscrew 5 which bears against the upper surface of the blade. The machine screws 4 may be directed from near the distal end of the shaft into the replacement blade, as shown in FIG. 1, or vice-versa as shown in FIG. 2.

For convenience, the blades will be collectively referred to as "replacement" blades throughout this specification and in the claims, regardless of whether the blades are of the same or different sizes.

Preferably, but not necessarily, the distal end has a male or female dovetail portion 6, onto or into which a corresponding female or male dovetail portion 7 of the replacement blade may be fitted. Preferably, the distal end has a shoulder portion 8 against which the replacement blade abuts, such that the forces generated when the tool is used are transmitted directly to the shaft, to avoid generating shear forces on the machine screws.

The distal end of the handle may have an angled surface 9, configured to align with the angled surface 10 of the replacement blade, at for example a standard angle such as 24–26 degrees, or at any other desired angle. For example, an 18 degree angle could be employed for lighter duty applications. The angle of the blade does not necessarily have to match the angle of the distal end of the holder.

Storage space for extra blades, i.e. blades of different width, may be provided in the handle 15 which is secured to the shaft. Preferably this is accomplished by virtue of a spring-loaded collar 16 which overlies lower portions 17 of elongated rotatable cover pieces 18, preventing rotation. The cover pieces pivot about a springmounted pin 19, and have recesses 20 therein to provide storage space. When the spring-loaded collar is retracted, the cover pieces can be rotated, to reveal storage areas on either side of the handle.

Figure 3:
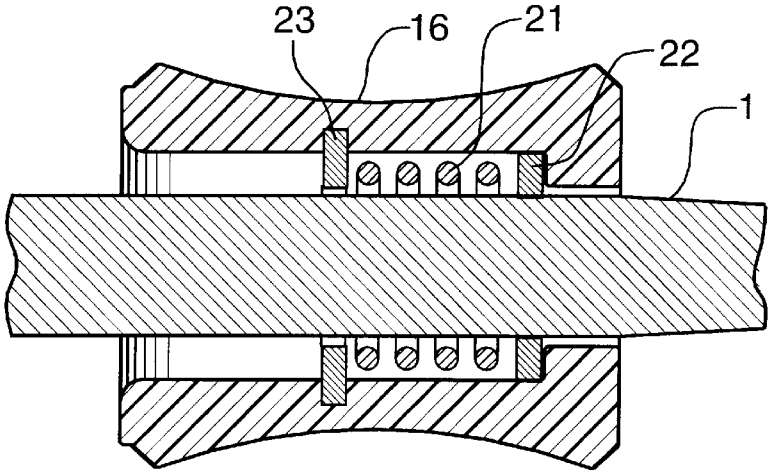
FIG. 3 is a cross-section of the spring-loaded collar.
Figure 5:
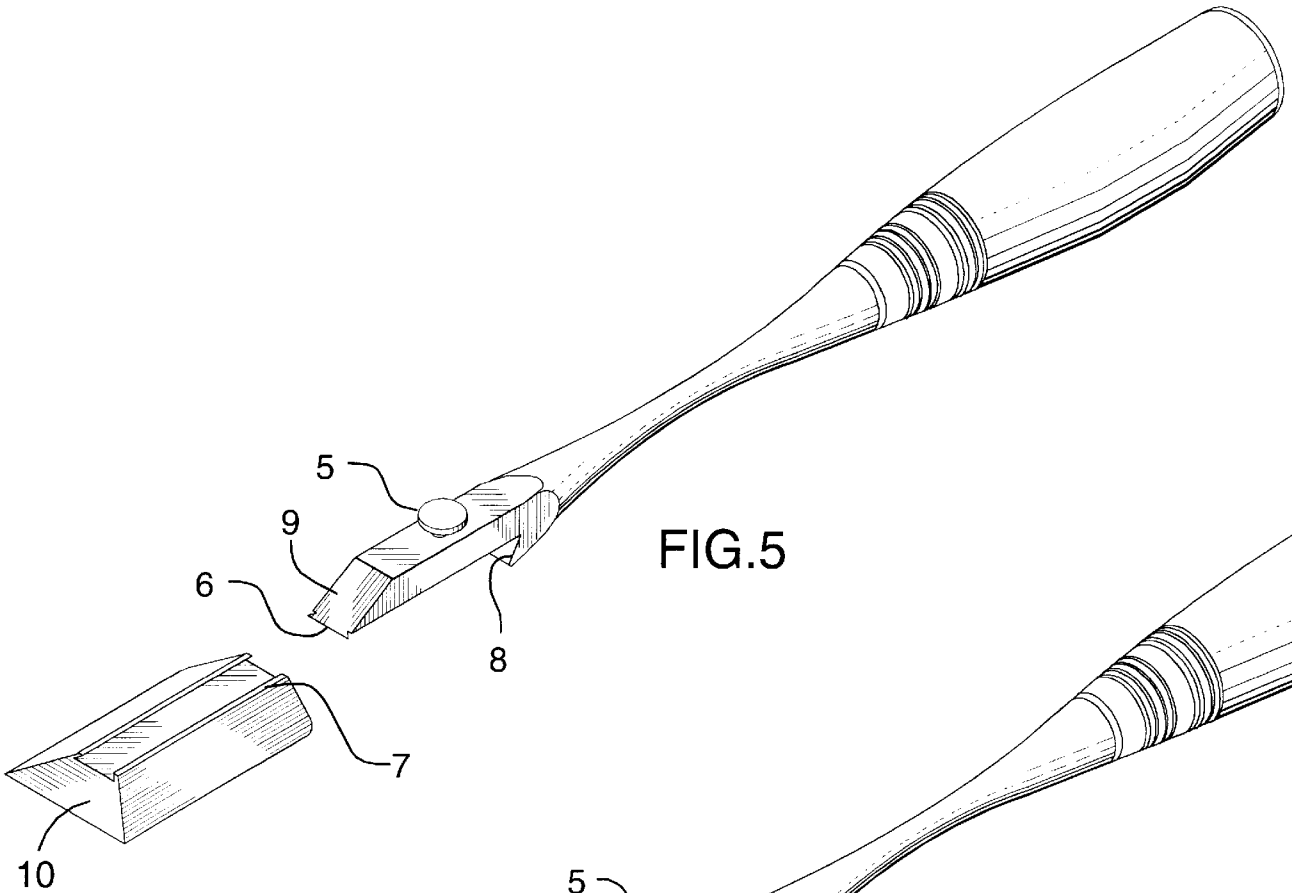
FIG. 5 is a perspective view of an alternative form of handle and a blade.
Figure 6:
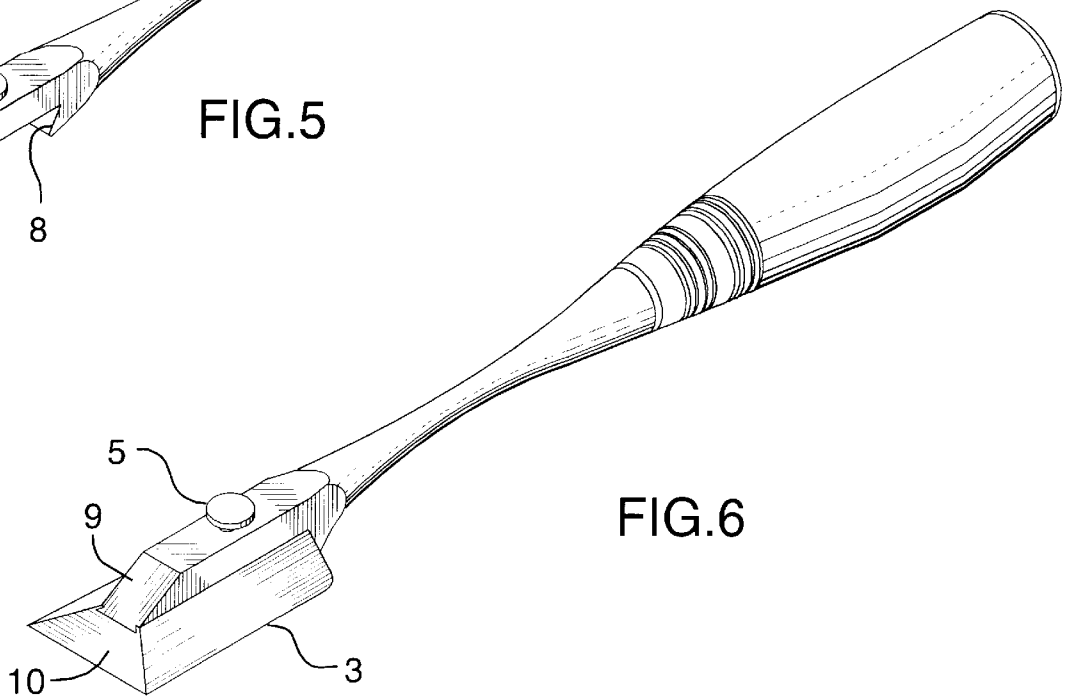
FIG. 6 is a perspective view corresponding to FIG. 5, with the blade installed.
Figure 7:
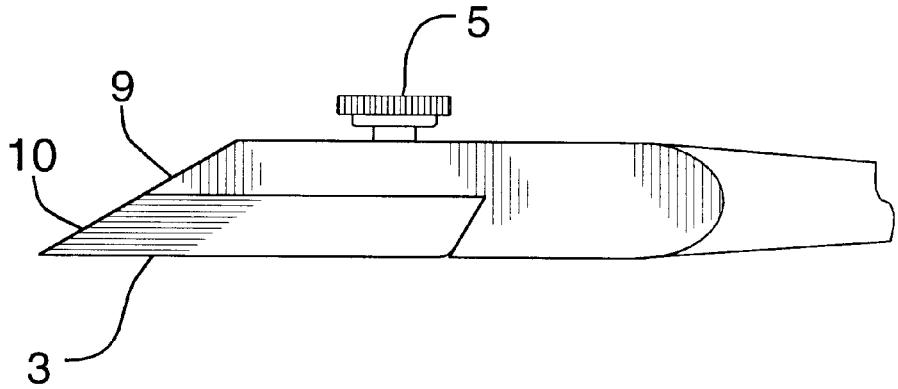
FIG. 7 is a side view of the distal portion of the alternative handle and blade.
Figure 8:
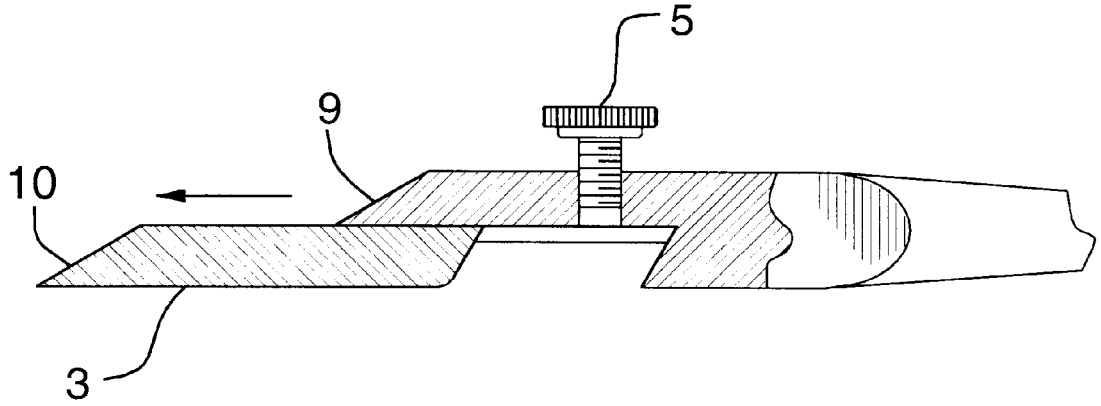
FIG. 8 is a side cross-sectional view corresponding to FIG. 7, showing removal of the blade.

As seen best in FIGS. 2 and 3, the collar 16 is mounted via a spring 21 between a pin 22 passing through the shaft 1 and a pin 23 or the like secured inside the collar.

Figure 9:
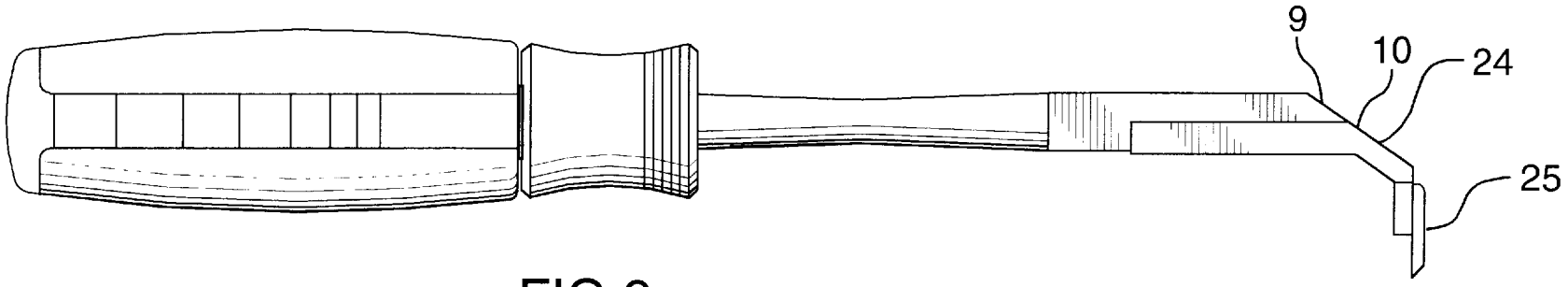
FIG. 9 is a side view of a scraper according to the invention.
Figure 10:
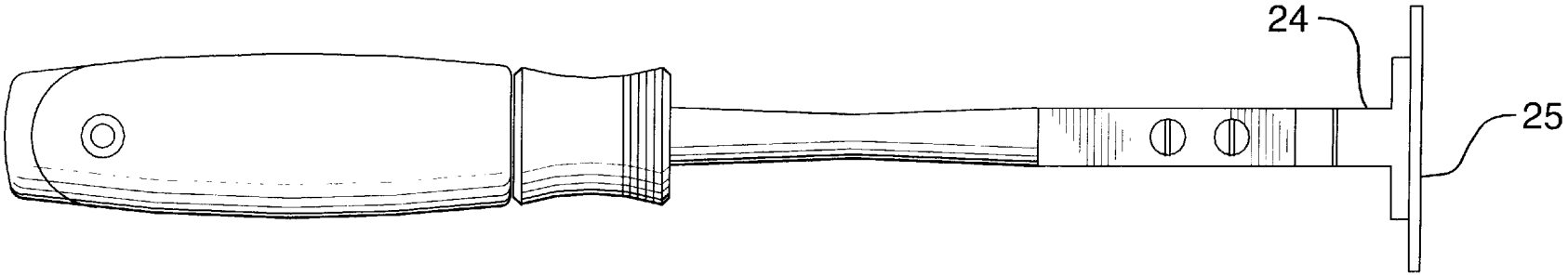
FIG. 10 is a plan view of the scraper.
Figure 14:
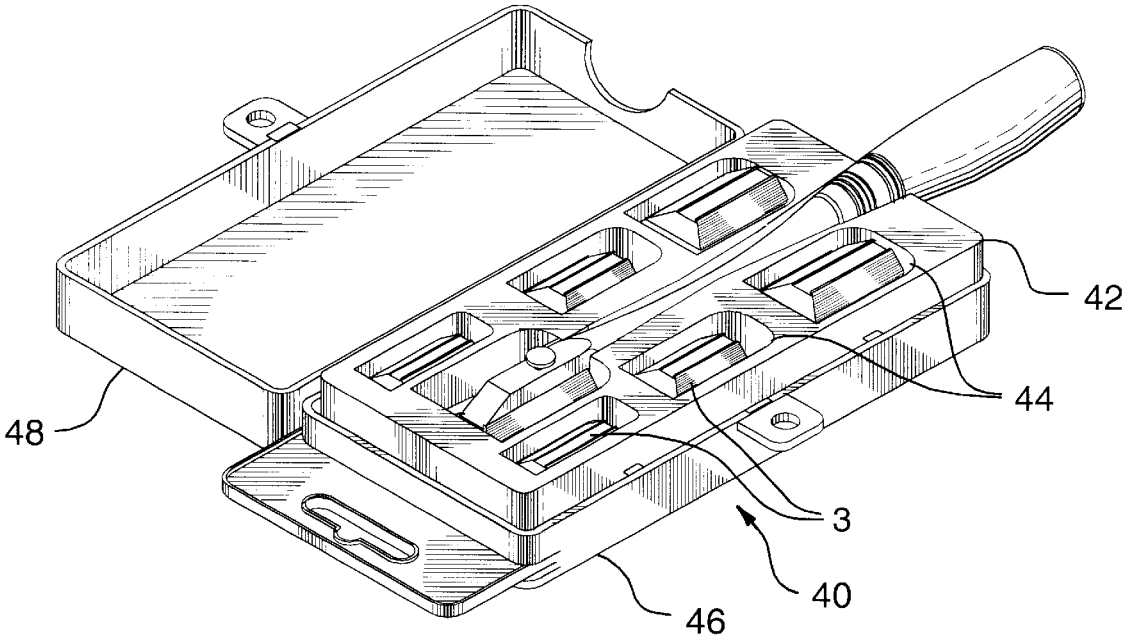
FIG. 14 is a perspective view of a "gift case" in combination with a chisel handle and replacement blades.
Figure 15:
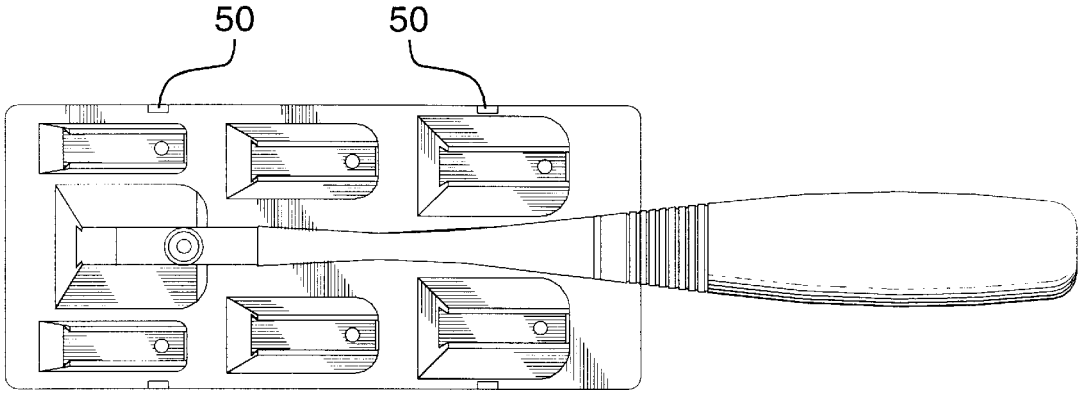
FIG. 15 is a plan view of the gift case insert which supports the chisel handle and replacement blades.
Figure 16:
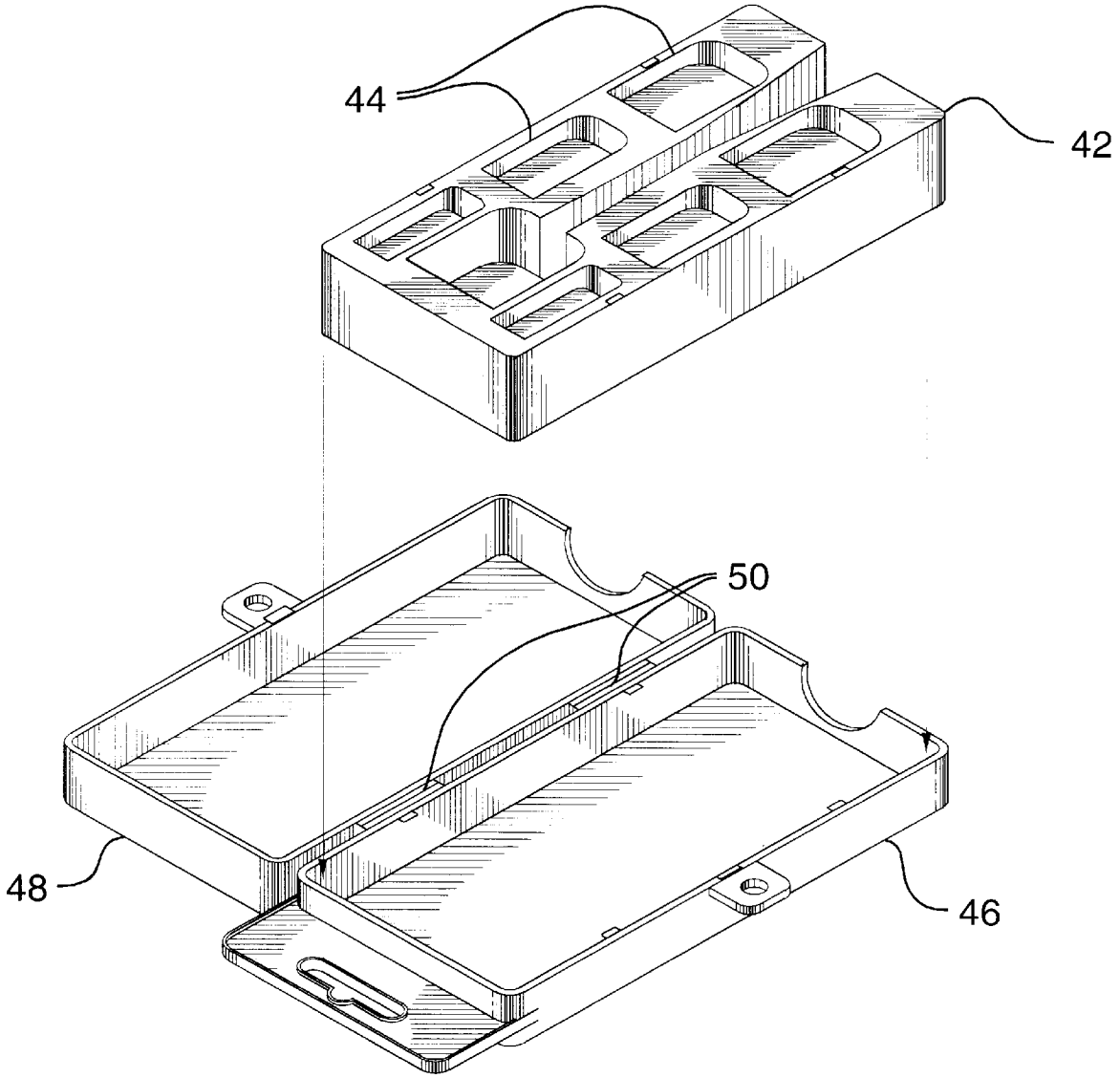
FIG. 16 is an exploded perspective view of the gift case.
Figure 17:
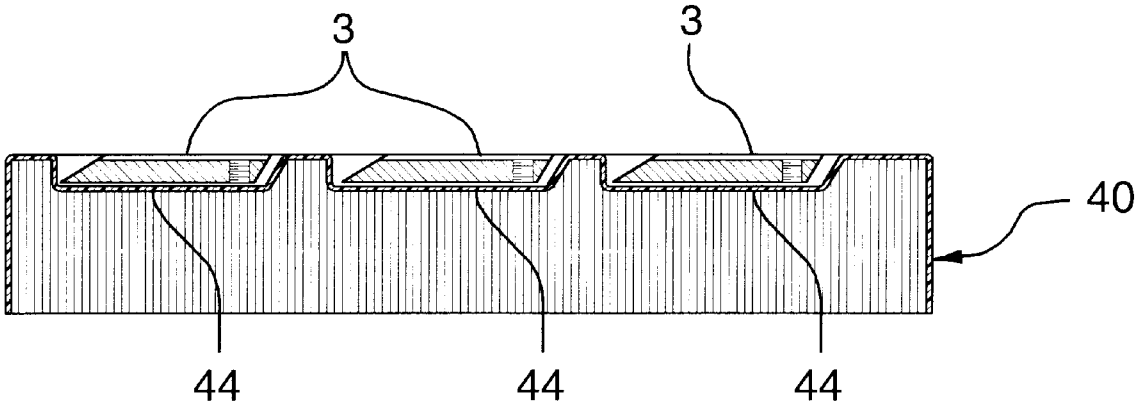
FIG. 17 is a cross-section of the insert along the line of the recesses for the replacement blades.
Figure 18:
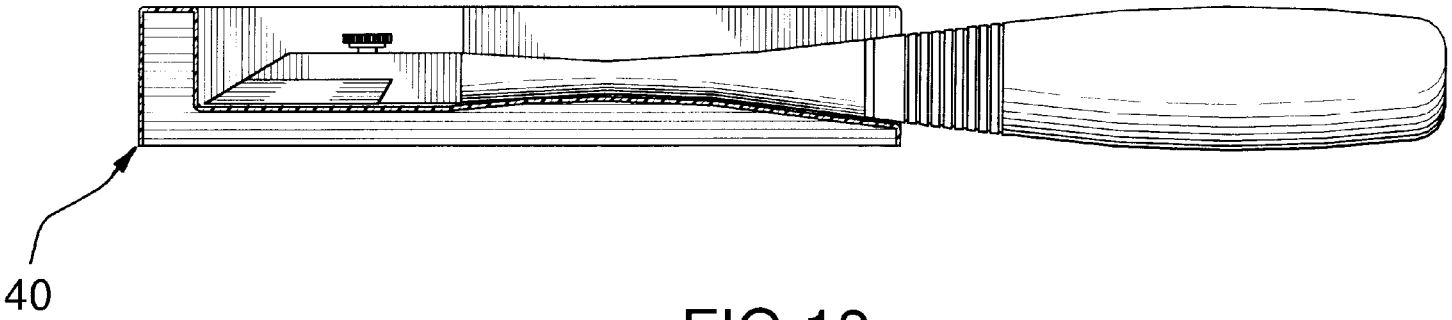
FIG. 18 is a cross-section of the insert along the line of the chisel handle.

FIGS. 9 and 10 show the identical principle being applied to a first version of a scraper, with replacement scraper blades assemblies, comprising a mount 24 and a blade 25. The details of the shaft are essentially identical to the chisel, such that the same handle and shaft could conceivably be used for either chisel or scraper blades. The recesses 20 could be reshaped if desired, or a "universal" recess shape could be used to accommodate either chisel or scraper blades. The same shaft could be used in either case, however.

FIGS. 11–13 show a different version of scraper, with a different form of shaft 31, simply having a broad distal end 32 onto which replaceable scraper blades 25 may be mounted.

Clearly, the same principle can be applied to a wide variety of tools, and the principle is not intended to be limited to the specific tools described above and shown in the accompanying drawings. For example, the same principle obviously could be readily adapted to putty knives or other similar tools.

Instead of storing the replacement blades in the handle, it may be preferable to provide a so-called "gift case" 40, having a panel insert 42 with recesses 44 therein to receive the replacement blades 3. The gift case has a typical base portion 46, with a preferably transparent lid 48 mounted thereto via hinges 50 or otherwise and securable by any suitable means, such as a conventional clasp. The handle cannot be removed from the case when the case is closed, because a blade is installed on the handle, and its width is greater than the diameter of the hole through which the handle projects.

The chisel or scraper handle is positioned preferably but not necessarily in the middle of the gift case, with for example three blade recesses 44 on each side. Any combination of blade sizes may be provided, and if desired, the blade angles may be mixed. For example, there could be three blades on one side with a standard 24–26 degree angle, and three blades on the other side with a shallower 18 degree angle, for lighter jobs. This provides the invention with the advantage of enabling a worker to use one tool for both roughing work and finishing work, i.e. by starting with a standard blade and then switching to a shallower angle blade, without having to carry around a number of different chisels.

The gift case can obviously can be configured very similarly, if not identically, for a scraper instead of a chisel, or for a combined scraper and chisel.

What is claimed as the invention is:

1. A hand tool, comprising an elongated handle and a shaft extending axially from one end of said handle, a distal end of said shaft remote from said handle being specifically configured to receive a complementarily-shaped replacement blade, and means for securing said replacement blade at said distal end of said shaft, said elongated handle having a storage area defined therein, configured to receive a plurality of replacement blades, where said storage area is provided by virtue of said handle having a cover portion which is pivotable in one plane between an open position where said storage area is exposed and a closed position where said storage area is covered, said hand tool further comprising a collar positioned around said shaft to overlie a portion of said cover portion to prevent pivoting thereof towards said open position, said collar being retractable to a position where said cover portion may be pivoted.

2. A hand tool as recited in claim 1, where said distal end of said shaft has a transverse shoulder portion positioned to be abutted by a portion of said replacement blade.

3. A hand tool as recited in claim 1, where said distal end of said shaft is provided with a male or female dovetail portion configured to mate with a corresponding female or male dovetail portion provided on said replacement blade.

4. A hand tool as recited in claim 1, where said hand tool is a chisel.

5. A hand tool as recited in claim 1, where said hand tool is a scraper.

6. A hand tool as recited in claim 3, in combination with a case, said case comprising a base portion, a panel positioned across said base portion, and a lid hinged to said base portion, said panel having a plurality of recesses therein to receive replacement blades, and a recess to accommodate at least a portion of said hand tool.

7. A hand tool as recited in claim 1, wherein said collar is spring-biased to overlie said portion of said cover portion, such that said collar is retractable against said spring bias to said position where said cover portion may be pivoted.

8. A hand tool as recited in claim 7, in combination with a case, said case comprising a base portion, a panel positioned across said base portion, and a lid hinged to said base portion, said panel having a plurality of recesses therein to receive replacement blades, and a recess to accommodate at least a portion of said hand tool.

9. The combination as recited in claim 8, where said hand tool is a chisel.

10. The combination as recited in claim 8, where said hand tool is a scraper.

11. A hand tool as recited in claim 7, where said hand tool is a chisel.

12. A hand tool as recited in claim 7, where said hand tool is a scraper.

* * * * *